United States Patent [19]

Truglio

[11] Patent Number: 4,669,912

[45] Date of Patent: Jun. 2, 1987

[54] VEHICLE BARRIER DEVICE

[76] Inventor: Ralph Truglio, R.D. 4, Box 149B, Washington, N.J. 07882

[21] Appl. No.: 741,808

[22] Filed: Jun. 6, 1985

[51] Int. Cl.[4] ..... E01F 13/00

[52] U.S. Cl. ..... 404/6

[58] Field of Search ..... 404/6, 9, 11; 49/49, 49/131

[56] References Cited

U.S. PATENT DOCUMENTS

| | | | |
|---|---|---|---|
| 4,016,679 | 4/1977 | Ellefson | 49/49 |
| 4,097,170 | 6/1978 | Dickinson | 404/6 |
| 4,101,235 | 7/1978 | Nelson | 404/6 |
| 4,318,079 | 3/1982 | Dickinson | 404/6 |
| 4,342,525 | 8/1982 | Mastronuzzi, Jr. | 404/6 |

FOREIGN PATENT DOCUMENTS

| | | | |
|---|---|---|---|
| 3305698 | 8/1984 | Fed. Rep. of Germany | 49/49 |
| 2032983 | 5/1980 | United Kingdom | 49/49 |

*Primary Examiner*—Stephen J. Novosad
*Assistant Examiner*—Bruce M. Kisliuk

[57] ABSTRACT

A vehicle barrier device adapted to disable or destroy unauthorized vehicles attempting to proceed therepast. Includes a plurality of vehicle impaling prong members elevateable from a first position in the road surface to an elevated and vehicle impaling position together with a vehicle arresting cable adapted to engage vehicle superstructure.

5 Claims, 6 Drawing Figures

VEHICLE BARRIER DEVICE

This invention relates to vehicle barrier devices and particularly to vehicle barrier devices adapted to disable or destroy unauthorized vehicles attempting to proceed therepast.

The recent spate of terrorist bombing attacks wherein a suicidal vehicle operator drives a vehicle loaded with explosives into proximity with a desired target has demonstrated the total inadequacy of conventional vehicle barrier devices, with or without the presence of armed guard personnel, to preclude such type of vehicle passage therepast.

This invention may be briefly described as an improved vehicle barrier adapted to selectively disable, if not effectively destroy, an unauthorized vehicle attempting to proceed therepast and which includes, in its broader aspects, a plurality of pivotally mounted vehicle piercing prong members selectively elevatable into vehicle impaling position in the path of vehicle advance in association with an elastically deformable vehicle arresting cable elevatable into vehicle engaging position by the elevation of said prong members. In its narrower aspects the subject invention includes a spring actuated prong elevation system biasable into retracted position by hydraulic action and a mounting system for such prong members that provides for destruction of such pivotal mounting through vehicle momentum when an impaled vehicle displaces such prong members past a predetermined elevational position. In a still further narrower aspect such invention includes the provision of selectively detonatable explosive charges within the vehicle impaling prong members.

Among the advantages of the subject invention is the provision of a vehicle disabling barrier mechanism that employs vehicle momentum as the source of vehicle disablement and with the degree of vehicle disablement and destruction being roughly proportional thereto. A further advantage is the provision of a readily transportable, easily installed and easily maintained vehicle disabling barrier device. Still another advantage is the provision of a hydraulically "cocked" system wherein vehicle impaling prong elevation is effected by release of stored spring energy so that elevation of the vehicle impaling prongs is independent of the hydraulically operable cocking mechanism. A still further advantage of the subject invention is the provision of a vehicle arresting cable engageable with the vehicle superstructure above the situs of vehicle impalement to assist in stopping vehicle motion after impalement and to also damage the upper portion of the vehicle front.

The object of this invention is the provision of an improved vehicle disabling barrier device.

Other objects and advantages of the subject invention will become apparent from the following portions of this specification and from the appended drawings which illustrate, in accord with the mandate of the patent statutes, a presently preferred embodiment incorporating the principles of this invention.

Referring to the drawings.

Figure 1:
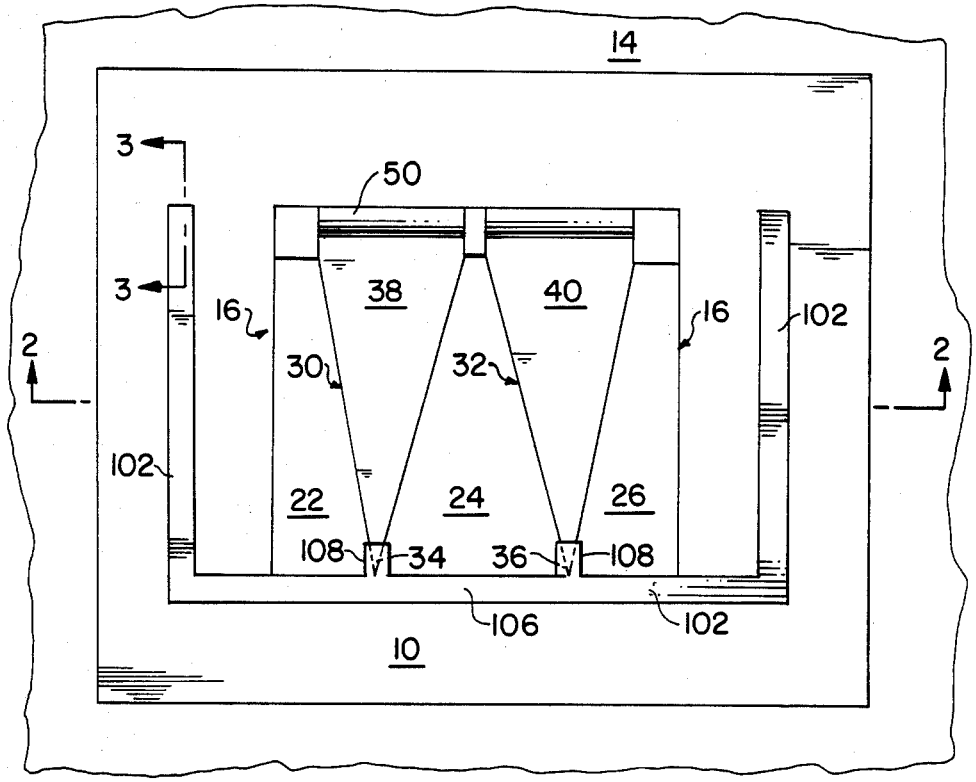
FIG. 1 is a schematic plan view of a two prong vehicle impaling barrier device incorporating the principles of this invention.
Figure 2:
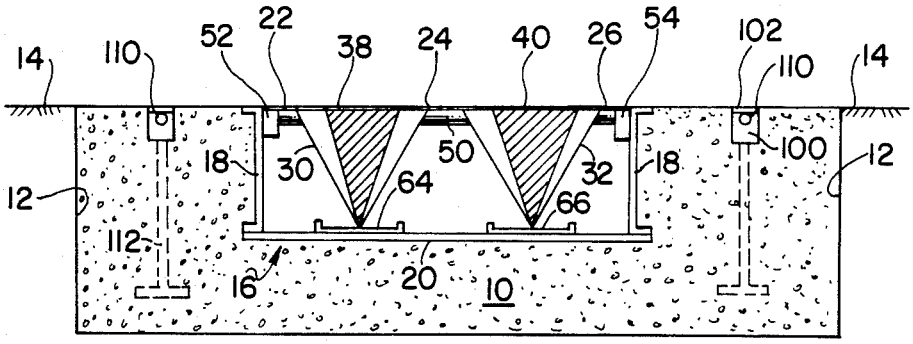
FIG. 2 is a section as taken on the line 2—2 of FIG. 1.

Referring to the drawings and initially to FIGS. 1 and 2, the improved barrier device, here shown in preferred form as a two element module, is adapted to be embedded in concrete 10 in a pit 12 in a road surface 14. There is provided a generally rectangular housing, generally designated 16, whose perimetric side walls are formed by steel beam elements 18, and whose base may constitute a steel plate 20, suitably perforated or sloped to accommodate a drainage system for rain water and the like. The upper surface of the housing 16 is partially formed by a plurality of selectively shaped and fixedly supported tread plates 22, 24 and 26 whose upper surfaces are disposed coplanar with and form a continuation of the road surface 14.

Also disposed within the housing 16 are a pair of vehicle impaling prong members 30 and 32 of generally pyramidal geometric configuration and tapering to points 34 and 36 facing the direction of vehicle advance. As best shown in FIG. 2 each of the prong members 30 and 32 are of a three sided nature and include upper surface 38 and 40 normally disposed coplanar with the tread plates 22, 24 and 26 and forming a continuation of the road surface 14.

The ends of the prong members 30 and 32 located remote from the points 34 and 36 are connected to a shaft 50 rotably supported at its ends in bearing blocks 52 and 54. Such mounting renders such prong members 30 and 32 pivotally displaceable from a first position wherein said upper surfaces are disposed coplanar with the tread plates 22, 24 and 26 to a second position where said pointed ends 34 and 36 are located at a predetermined distance above the road surface 14, suitably about 22–24 inches.

The prong members 30 and 32 are preferably formed of welded steel plate and are desirably filled with concrete to increase both the weight, strength and rigidity thereof. If desired each of the prong members may contain a predetermined charge of explosives in association with a timing device to effect detonation at a predetermined time following vehicle impact.

Figure 4:
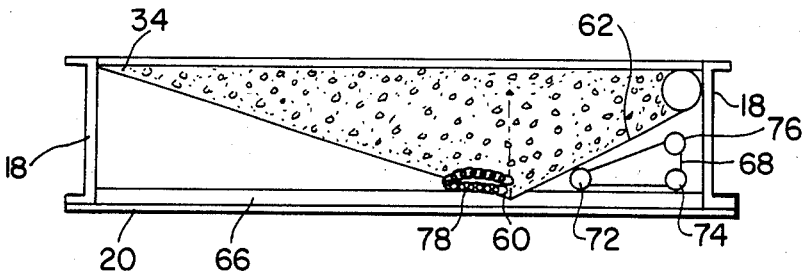
FIG. 4 is a schematic vertical section of a vehicle impaling prong member and the elevating wedge assembly therefore.
Figure 5:
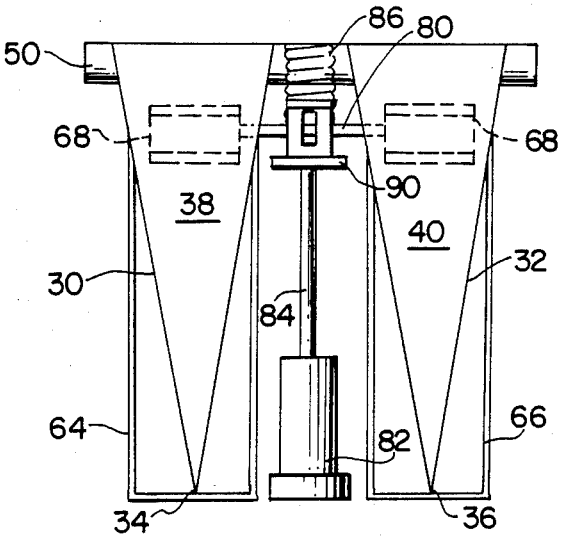
FIG. 5 is a schematic plan view of the elevating system for the two prong module.
Figure 6:
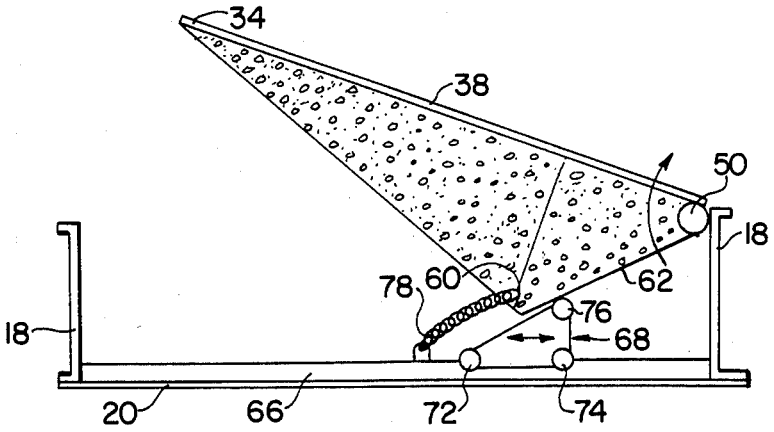
FIG. 6 is a schematic vertical section of the elevating system for the two prong module showing the prongs in elevated position.

A presently preferred system for elevating the tips of the prong members 30 and 32 from their retracted position coplanar with the road surface to their elevated and vehicle impaling position is schematically depicted in FIGS. 4–6. As there shown, the undersurface of the prong members are contoured to provide an apex 60 and a rearwardly adjacent upwardly sloping camming surface 62. Disposed beneath the longitudinal center line of the prong members 30 and 32 and supported by the base plate 20 are a pair of channel members 64 and 66 (see FIG. 2) whose upwardly directed side wall portions form guide channels for displaceable camming elements, generally designated 68. In more particularity, each camming element 68 includes a generally wedge shaped body portion 70 having transverse round bar members 72, 74 and 76 at the apices thereof. As will now be apparent, linal displacement of the camming element 68 within the track confines from the position illustrated in FIG. 4 to the position illustrated in FIG. 6 will result in a cam induced clockwise rotative displacement of the prong members and shaft 50 and in an elevation of the prong member points 34 and 36 from the retracted position illustrated in FIG. 4 to the elevated position illustrated in FIG. 6. The described system also includes one or more chains 78 connected between the movable prong members 32 and 34 and a ground anchor to limit the degree of upward displacement of the prong members, particularly after the momentum of an impaled vehicle is operative to further displace the prong members. As will be apparent the strength of such chain can be predetermined to deform and subsequently break in accord with momentum forces engendered by a moving vehicle. If such chains 78 are broken continual rotative displacement of the prong members results in enhanced degrees of vehicle destruction.

FIG. 5 shows, in schematic form a presently preferred actuating mechanism for effecting prong member elevation. As there shown the displaceable camming elements 68 are interconnected for conjoint displacement by a transverse bar 80. Desirably, the means for effecting prong element elevation should be independent of other system parameters in that once an actuating signal is energized the prongs should rapidly elevate entirely independent of other system parameters such as availability of electric power or hydraulic pressure. To the above ends the actuating system includes a hydraulic cylinder 82 whose piston 84 will normally be in extending position to compress a spring 86 disposed intermediate the transverse bar 80 and a base wall position. The spring 86 will be normally biased in compressed condition by hydraulic pressure within the cylinder 82 maintaining the camming elements 68 in their retracted position. Upon receipt of an energizing signal the hydraulic cylinder 82 will be vented resulting in a drop in hydraulic pressure and in a displacement of the camming elements 68 under spring reformation and a consequent elevation of the prong members 30 and 32. As will be apparent, the system is "cocked" by application and maintenance of hydraulic pressure and the prong members will be elevated solely by the stored energy contained in the compressed spring 86.

Figure 3:
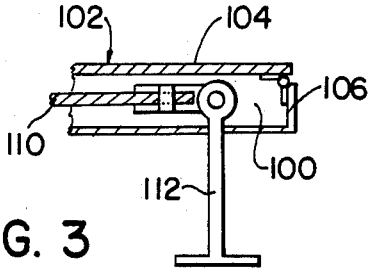
FIG. 3 is a section taken on the line 3—3 of FIG. 1.

As mentioned earlier the improved vehicle barrier system also includes a cable element adapted to engage the vehicle superstructure concurrent with vehicle impalement. As best shown in FIGS. 1–3 such cable system includes a generally U-shaped recess !00 surrounding the receptacle 16. Such recess is covered by a U-shaped frame element 102 whose free ends 104, as best shown in FIG. 3, are pivotally mounted in the rear wall 106 of the receptacle 100. The base arm 106 of the frame element 102 is frangibly secured to the prong points 34 and 36 as at 108 so that the frame 102 will be elevated in conjunction with the elevation of the prong members 30 and 32. Disposed within the recess 100 is an elongate steel cable 110 connected to the frame element 102 and elevatable in conjunction therewith. As best shown in FIG. 3 the ends of the cable 110 are pivotally connected to an anchor 112 firmly enbedded in the concrete fill 10.

In the operation of the described system, the prong members 30 and 32 are normally maintained in retracted position with the upper surfaces 38 and 40 displaced coplanar with the road surface 14. In such position the piston rod 84 is held in its advanced position by hydraulic pressure within the cylinder 82 with the spring 86 in its fully compressed condition and the camming slide element 68 in retracted position. System activation and elevation of the prong members 30 and 32 is effected by release of the hydraulic pressure within the cylinder 82 permitting the stored energy in the spring 86 to advance the camming slide 62 and to elevate the prong points above the road surface in about one second or less. The elevation of the prong points 34 and 36 will also effect a conjoint elevation of the frame element 102 and cable 110 to thus place both the prong points 34 and 36 and the cable 110 in the path of an oncoming vehicle.

In operation, the momentum of an oncoming vehicle will result in impalement of such vehicle on the prong members 30 and 32 and in effective disablement, if not destruction of the front end portion of the vehicle. Concurrently therewith the vehicle impact will serve to break the frangible connection between the cable supporting frame 102 and the prong members and permit engagement of the cable 110 with the vehicle superstructure. Such cable engagement not only operates to damage the vehicle superstructure but also operates in conjunction with the prong members, to bring the disabled vehicle to a halt.

Having thus described my invention, I claim:

1. A vehicle impaling barrier device positionable in a road surface for precluding unauthorized vehicle passage therepast, comprising a pair of elongate vehicle impaling prong members of pyramidal geometry, each having a planar upper surface and tapering to a point facing the direction of vehicle advance;

means pivotally mounting said prong members at the end remote from said points to permit displacement thereof from a first position wherein said upper surfaces thereof are normally disposed coplanar with said road surface to a second position where said points are elevated a predetermined distance above said road surface sufficient to engage and impale the body portion of a vehicle attempting to proceed therepast;

means responsive to a predetermined signal for effecting displacement of said prong members from said first position to said second position.

2. The vehicle barrier as set forth in claim 1 wherein said prong members are formed of metal plate and are filled with concrete.

3. The vehicle barrier as set forth in claim 1 further including generally U-shaped cable having its end portions anchored in the vicinity of said pivotal mounting means and its intermediate portion releasably supported by the pointed ends of said prong members and displaceable in conjunction therewith as in said prong members are displaced from said first to said second position.

4. The vehicle barrier as set forth in claim 1 wherein the pointed ends of said prong members contain selectively detonatable explosive charges.

5. A vehicle barrier as set forth in claim 1 wherein said prong members are normally biased overcoming restraint in said first position in response to said predetermined signal.

* * * * *